United States Patent [19]

Pardue et al.

[11] 4,266,117

[45] May 5, 1981

[54] SELF-VENTILATING INFRA-RED RAY HEATER

[75] Inventors: Ray L. Pardue, Chagrin Falls; Arnold L. Buehl, Solon, both of Ohio

[73] Assignee: Econoray, Inc., Solon, Ohio

[21] Appl. No.: 958,169

[22] Filed: Nov. 6, 1978

[51] Int. Cl.[3] ..... H05B 1/00; H05B 3/44

[52] U.S. Cl. ..... 219/343; 219/347

[58] Field of Search ..... 219/343, 345, 354, 405, 219/411, 352, 342, 348, 357, 377, 531; 362/217-219, 373

[56] References Cited

U.S. PATENT DOCUMENTS

| | | | |
|---|---|---|---|
| 1,975,605 | 10/1934 | Hartwig | 219/343 |
| 2,338,077 | 12/1943 | Scribner | 219/343 |
| 2,495,513 | 1/1950 | Doyle . | |
| 2,590,417 | 3/1952 | Jones | 219/342 |
| 2,667,563 | 1/1954 | McOrlly | 219/347 |
| 2,951,928 | 9/1960 | Gialanella | 219/347 |
| 3,032,638 | 5/1962 | Hall | 219/347 |
| 3,045,100 | 7/1962 | Mills | 219/354 |
| 3,089,940 | 5/1963 | Norton . | |
| 3,149,223 | 9/1964 | Zimmerman | 219/347 |
| 3,171,945 | 3/1965 | Meng et al. | 219/347 |
| 3,278,722 | 10/1966 | Fannon, Jr. et al. | 219/343 |
| 3,294,955 | 12/1966 | Anoff | 219/347 |
| 3,731,055 | 5/1973 | Kerchner, Jr. | 219/354 |
| 3,733,461 | 5/1973 | Rohats | 219/343 |
| 3,867,948 | 2/1975 | Kallenborn | 219/354 |

*Primary Examiner*—B. A. Reynolds
*Assistant Examiner*—Bernard Roskoski
*Attorney, Agent, or Firm*—Woodrow W. Portz

[57] ABSTRACT

A self-ventilating infra-red ray heater having cooperating housing, endplate and internal reflector structure which results in standardized construction of parts which may be included in single or multiple element heaters. The invention seeks maximum utilization of inexpensive sheet metal components to obtain heaters of low manufacturing cost especially suitable for use in portable heaters which may be oriented to direct heat in any direction. In the aforenamed structure, an internal reflector is received in an arcade-type housing to form a space or jacket enclosing except for openings in opposite ends of the crown of the housing for communication of the space with the atmosphere. Preferably the end plates are formed with flanges which overhang the openings with clearance to protect against entry of unwanted materials into the space.

7 Claims, 23 Drawing Figures

SELF-VENTILATING INFRA-RED RAY HEATER

BACKGROUND OF THE INVENTION

A review of the prior art of infra-red heaters will disclose that there are few heater assemblies which are satisfactory in respect to lightweight simplified construction required for use in portable or mobile heaters. It is desirable in such heaters that the heat-radiating unit may be oriented to positions of any angle including inverted positions such as obtainable by the dolly-type heater disclosed in Patent Application Ser. No. 920,488 filed June 29, 1978. The most heat-sensitive component of such heaters is the interior reflector, especially, if it comprises a light gage material such as thin polished aluminum sheet. A relatively inexpensive relfector may be used if it is adequately ventilated. However, when adequate ventilation is provided, protection is required under many uses through shielding of the reflector components from snow, rain, bird and insect debris such as, nesting materials, etc. Another heat-sensitive portion of an infra-red heater is the terminal box. Connection of the heat element with power sources is required in a manner avoiding overheating of power supply wires adjacent to the point of connection.

The uses to which an infra-red ray heater is to be subjected as contemplated herein include a great variety of stationary and mobile applications under any weather condition. The need for a durable lightweight infra-red ray heater is especially desired for mounting in a portable unit.

Hence, objects of the invention are to provide a basic unit in the form of an infra-red ray heater which is self-ventilating; constructed primarily of sheet materials to attain lightweight, weatherproof, and conveniently attachable as a unit to portable or fixed mounting apparatus. A further object is to provide a specific combination of components arranged in a unique design to achieve the aforenamed objects.

SUMMARY OF THE INVENTION

The above and other objects are achieved in the provision of an infra-red ray single-element or multiple-element heater comprising an arcade-type housing for each element, end plates secured across the ends of the housing, an elongate heating element mounted in one of the end plates and extending along the length of the housing, hanger means engaging spaced portions of the heater element and engaging longitudinally-extending opposite side-wall portions of the housing, and an interior reflector for the housing of flexible sheet material of a width such as to deform with its edges inserted between the side walls and/or portions of the hanger means which connect with the side walls. The body of the reflector is spaced from both the inner surface of the housing on one side and the element on its other side.

As an essential feature, the ends of the reflector may fit in close proximity with the end plates but portions of both ends of the housing are longitudinally recessed, or otherwise apertured adjacent the end plates, to allow passage of cooling air through the space between the inner reflector and the housing.

In a preferred embodiment, the heater also includes a two-chamber terminal box mounted fixedly in closely-spaced relation with the adjacent end plate on an exterior mounting section of the heating element. One chamber of the terminal box receives end portions of the element mounting section. Electrical connectors extend through a chamber-separating partition from the terminals of the elements to form junctions with power supply lines in the other chamber. The partition is a heat barrier protecting the power-line junctions.

In a preferred embodiment, each end plate is constructed with a bottom flange and an upper flange which extend in opposite directions from the main plane of the end plate. The upper flange is normally in-turned over the housing and functions as: (1) means for securement to a supporting vehicle or fixture, and (2) constitutes cover means in overlapping spaced relation with end portions of the housing defining ventilation openings or notches/or a weatherproofing shroud fitted over the housing. The lower flange is out-turned with respect to the housing and is utilized as a support to which to attach an outer frusto-pyramidal reflector of the heater. Both flanges function as stiffening structure for the end plate.

DESCRIPTION OF PREFERRED EMBODIMENTS

Figure 12:
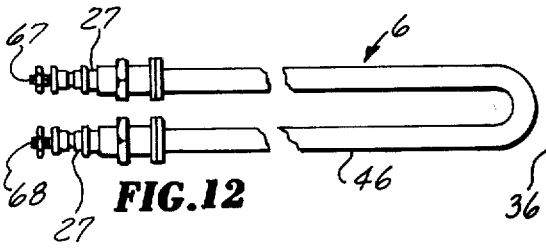
FIG. 12 is a plan view of an infra-red ray generating element which is a portion of the heaters described herein.

FIGS. 1 to 6 illustrate in its entirety a single-element infra-red ray heater unit or fixture 5 shown independently of any attachable mobile or stationary supporting structure. The heater 5 is designated "single-element" because it includes but one U-shaped element 6 as shown in FIG. 12. As major components, the heater 5 comprises the aforesaid element 6, an arcade-type housing 7, element hangers 8, an inner reflector 9, a first or front end plate 10, a second or rear end plate 11, a weather shield 12, an outer or lower reflector 13, and a terminal box 14. With the exception of the element 6, these components may all be constructed of sheet metal material. Although the heater 5 may be oriented in any angle of radiation in three dimensions, components may be referred to hereinbelow and in the claims as "upper" or "lower", or relatively "above" or "below" as found in FIGS. 3 to 6 wherein the heater is shown oriented to radiate vertically downwardly.

Considering now the details of the components, the housing 7 is of sheet-like elongate dehedral, flat-topped construction with its end surfaces defining openings 16, 17 immediately upwardly of threaded studs 19. The openings, or other similarly located openings, function as ventilation ports in the assembled heater. The housing is preferably of sheet metal to which the studs 19 are attached, as by welding, to project beyond the full length of the sheet material for extension through holes or apertures 26 of the end plates 10, 11 to receive nuts 20. The housing 7 is formed dihedrally along its lower edge to provide the in-turned flanges 21, 22 which function as detent shoulders, i.e., supporting structure, for the element hangers 8 and the inner reflector 9. The term "arcade" is intended to refer to any arcuate, truncated, or rectangular, geneally U-shaped cross section of the housing 7.

Figure 1:
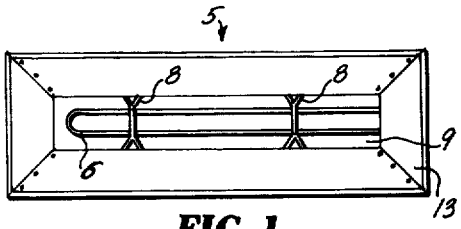
FIG. 1 is a bottom view of a single-element heater in accordance with the invention.
Figure 2:
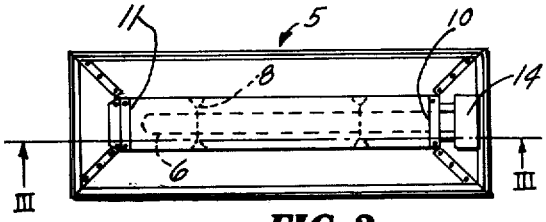
FIG. 2 is a top view of the heater shown in FIG. 1.
Figure 3:
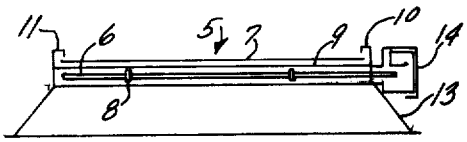
FIG. 3 is a schematic elevation in section taken along line III—III of FIG. 2.
Figure 4:
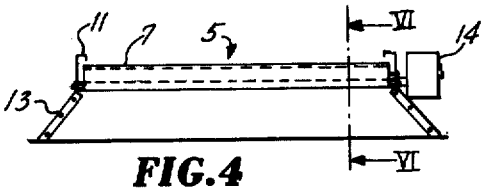
FIG. 4 is a side elevation of the heater of FIGS. 1, 2 and 3.
Figure 5:
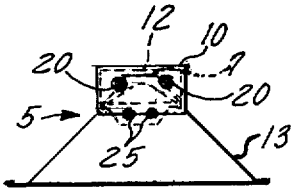
FIG. 5 is an end view of the heater of the previous figures with a terminal box removed.
Figure 6:
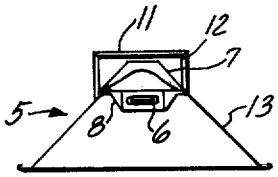
FIG. 6 is schematic section view taken along line VI—VI of FIG. 4.
Figure 7:
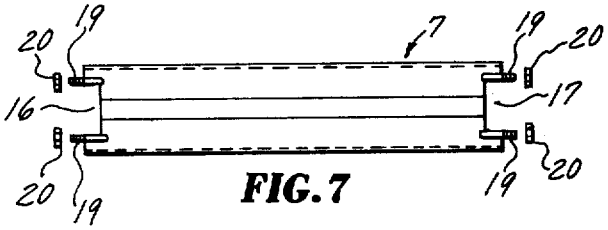
FIG. 7 is a plan view of a housing which is a portion of the heater of the previous figures.
Figure 8:
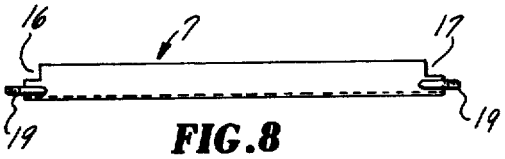
FIG. 8 is a side view of the housing of FIG. 7.
Figure 9:
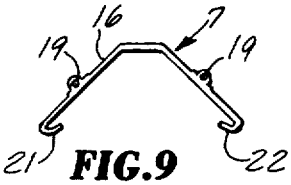
FIG. 9 is an end view of the housing of FIGS. 7 and 8.
Figure 10:
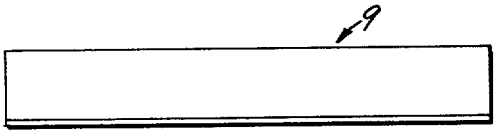
FIG. 10 is a side view of a reflector which is a portion of the heater of FIGS. 1 to 6.
Figure 11:
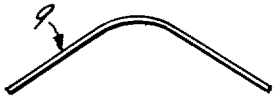
FIG. 11 is an end view of the reflector of FIG. 10 as shown in its normally deflected concavo-convex condition as mounted in the heater.
Figure 20:
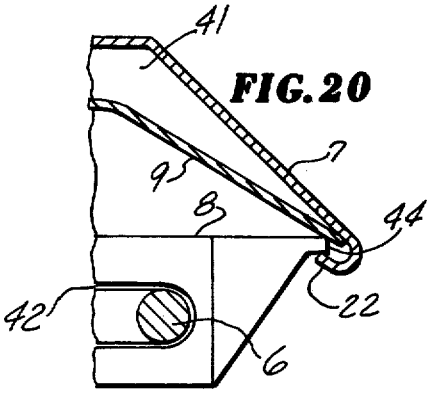
FIG. 20 is an enlarged cross sectional view of certain portions of the heater as shown in cross section in FIG. 6.
Figure 21:
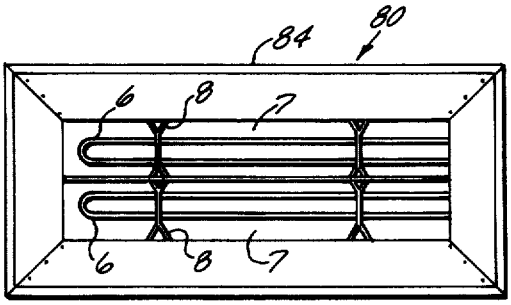
FIG. 21 is a bottom view of the heater of FIGS. 15 and 21.
Figure 22:
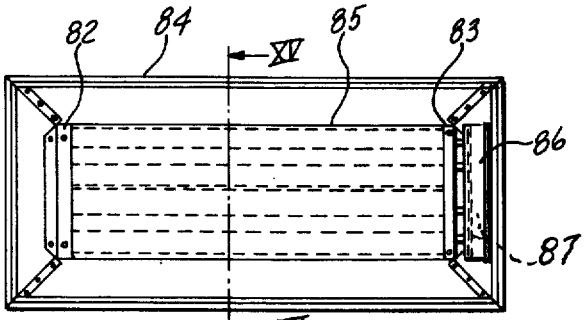
FIG. 22 is a top view of the heater of FIGS. 15 and 14.
Figure 23:
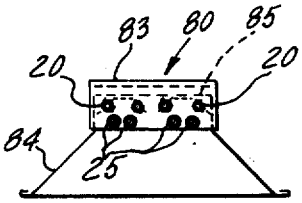
FIG. 23 is an end view of the heater of FIGS. 15, 21 and 22.

FIGS. 10 and 11 illustrate the inner reflector 9 which is normally provided as a flat piece of sheet metal, for example, thin polished aluminum, and deformed to the concavo-convex configuration shown to fit within the housing 7 to extend between the housing flanges 21, 22 with its lateral edges engaging the hangers 8 and the inner surfaces of the housing side-wall as shown in FIG. 20. Since the reflector 9 is received within the housing with end surfaces in close proximity with the end plates 10, 11, the reflector is cut within a one- or two-thousands of an inch shorter than the housing 7. Thus, the entire periphery of the reflector 9 extends into close continuous proximity with the end plates and the side-wall portions of the housing.

Figure 17:
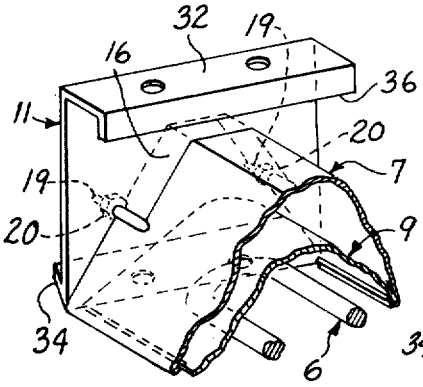
FIG. 17 is a fragmentary perspective view of an end plate and portions of a housing, a reflector, and a heating element for use in the heater of FIGS. 1 to 6.
Figure 18:
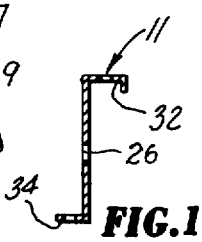
FIG. 18 is a cross sectional view of the end plate of FIG. 17.
Figure 19:
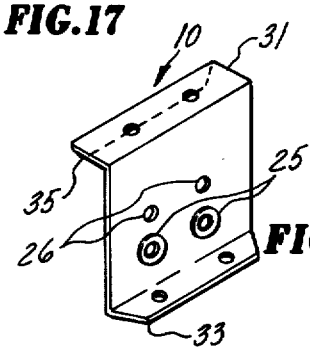
FIG. 19 is perspective view of an end plate adapted to support a heater element as used in the single element heater of FIGS. 1 to 6.

FIGS. 13 and 17 to 19 illustrate the end plates 10, 11. They may be of identical construction except that plate 10 is apertured with holes 25 through which the mounting sections 27 of the element 6 normally extend. The end plates are also provided with apertures 26 which receive studs 19 of housing 7. Plates 10 and 11 comprise cover means for the openings 16, 17 in spaced relation with the crown portion of the housing, such as upper flanges 31, 32 respectively, and lower flanges 33, 34, respectively. As shown, these flanges extend at right angles with the main plane of respective plates. Upper flanges 31, 32 have such functions as (1) horizontally overhanging and overlapping the openings 16, 17 of the housing and the corresponding gaps between the ends of the weather shield 12 and the end plates to increase weather protection while affording housing ventilation; (2) stiffening the heater construction; (3) providing a rigid heater component for attachment to a stationary or mobile base. As shown in FIG. 17, opening 16 is defined by the perimeter of the notch in the housing and a projection line 30 in dot-dash. The flanges 31, 32 further comprise distal webs 35, 36, respectively, which extend downwardly or inwardly toward the crown portion of the housing 7. Thus, as shown, flanges 31, 32 are of L-shaped cross section. The webs 35, 36 further stiffen the heater and act as an additional barrier preventing entrance of weather precipitation and miscellaneous debris to the region of cavity 41, between the reflector 9 and the housing 7, and also the valleys between adjacent housings of a multiple-element heater.

Figure 13:
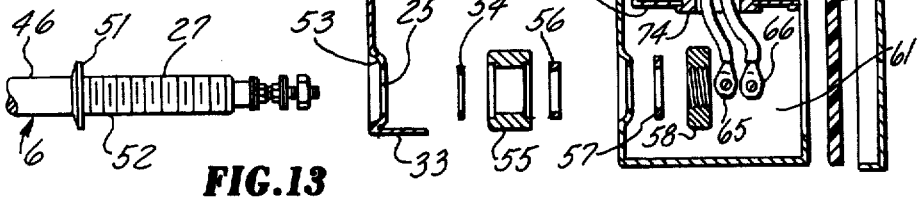
FIG. 13 is a fragmentary exploded view of the element from FIG. 12, an end plate illustrated in FIG. 19, spacing washers, and a terminal box which are, or are exemplary of, portions of heaters described herein.
Figure 14:
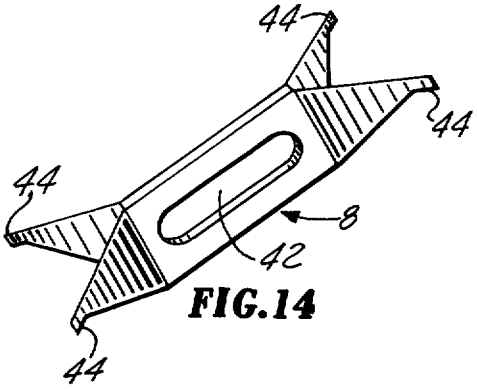
FIG. 14 is a perspective view of a hanger for securing a heater element to a heater housing.
Figure 15:
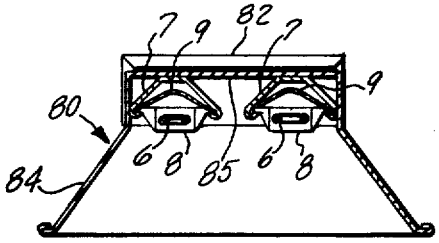
FIG. 15 is a schematic transverse cross section of a heater exemplyfing multiple heater-element construction.

FIGS. 13, 14 and 20 illustrate a mode of supporting various components, especially the element 6, within the housing 7. FIGS. 14 and 20 especially illustrate the construction of the quadri-winged hanger 8 which is normally used in a plurality to position the element somewhat exteriorily of the longitudinal cavity 41 defined by the housing at a desired distance from the reflector 9. The element 6 is supported by the hangers within the aperture 42 thereof. The hangers are in turn supported on the shoulders facing inwardly of the cavity 41 and defined by the upper surfaces of the flanges 21, 22 through engagement therewith by hanger tabs 44. As more clearly shown in FIG. 20, the reflector 9 is resiliently deformed to a concavo-convex cross section to dispose its edges into an entrapment region at the confluence of the housing 7. This mode of element support occurs at longitudinally spaced portions of the heat-emitting section 46 of the element.

To obtain support of the element and the terminal box on the end plate 10, element 6 is provided with a fixed flange 51 (optionally, a nut on its threaded area 52) at the junction of its sections 27, 46 which is received in the recessed apertured boss 53 of the plate 10. When assembled in the order indicated in FIG. 13, element section 27 protrudes to the right of the plate 10 with a fiber washer 54, a collar 55 of larger internal diameter than the external diameter of threaded area 52, a fiber washer 56, box 14, metal washer 57, and a nut 58 all located on element mounting section 27. Tightening of the nut 58 on the threaded area compacts the above named items against the plate 10 into an assembly which resists the transfer of heat from the heat-emitting section 46 and establishes rigid support of the element and the terminal box on the end plate and housing assembly. The circular embossed areas surrounding holes 25, 76 and 77 serve to axially locate the legs of the element 6 within the holes as the nuts 58 are tightened.

Figure 16:
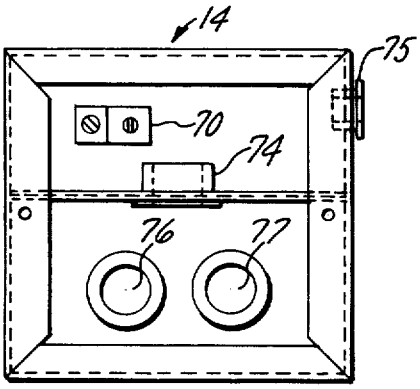
FIG. 16 is an end view of a terminal box for a one-element heater with the lid removed to illustrate the interior.

The box 14 is separated into two chambers 61, 62 by a partition 63. Chamber 61 receives element section 27, washer 57 and nut 58 and also portions of high-temperature resistant connectors 65, 66 which are during use connected with terminals 67, 68 of the element 6. Connectors 65, 66 are connected within the low-temperature chamber 62 with two wires of a conventional powerline cable 69 normally provided with less temperature resistance than connectors 65, 66. The third wire (ground wire) is connected with the ground terminal 70 of the box 14. The box further comprises a lid 71 functioning as a closure for box opening 72, and a gasket 73 useful as a seal between the lid and adjacent box portion. FIG. 16 is a view of the box 14 with the lid 71 and gasket 73 removed. Grommet 74 aids in the electrical and thermal insulating and sealing of the chamber. Opening 75 is provided for the installation of a waterproof strain-relief conduit fitting not shown. Holes 76 and 77 receive the two legs of element 6.

FIGS. 15, 21, 22 and 23 illustrate a heater 80 comprising two elements 6 which in principal typify multiple element heaters generally. It should be noted that the multiple-element heater comprises many components common to the single element heater of FIGS. 1 to 6. Modification of the single element heater to the multiple element heater occurs primarily in extending the length of the end plates thus enabling a single end plate, e.g., end plate 82 or 83, to attach to a plurality of housings 7. In the multiple element heater, the outer reflector 84 and a weather shield 85 are made in single pieces of sufficient width to embrace a plurality of housing 7.

As also shown with respect to shield 12 of FIGS. 1 to 6, shield 85 is shorter than the distance between end plates 82, 83 to provide gaps between the ends of the end plates which expose the recesses 16, 17 of the shields 7. The shield 12 or 85 is preferably sufficiently long to extend under the upper flanges of the end plates. Thus, the length of the shield should be at least as long as the distance between the upper flanges.

The terminal box 86 may be made correspondingly longer than the box 14 to receive multiple pairs of element legs. While single-element boxes 14 may be used on the heater 80, a single longer box simplifies construction, lessens cost, and rigidifies the heater. Similarly as described with respect to terminal box 14 and its partition 63, box 86 has a partition 87 dividing the interior of the box into two chambers enabling the power line junctions to occupy a chamber separate from the one into which the heating elements protrude.

What is claimed is:

1. A self-ventilating infra-red ray heater comprising:

an arcade-type housing having a crown portion and terminating laterally in opposite wall portions in respect to its longitudinal axis to define a longitudinally coextensive cavity and an opening therefor between said side-wall portions;

an elongate heating element having a heat-emitting section of a length substantially that of the housing adapted to be mounted adjacent to said opening with a mounting section of the element extending beyond one end of the housing;

first and second end plates of a size sufficient to cover the opposite ends of said housing;

first fastening means for securing the element to said first end plate;

second fastening means for securing said end plates to said housing;

said crown portion having notches within end portions thereof adjacent said end plates to define ventilation ports therethrough;

said end plates have upper flanges turned inwardly over, and spaced from, said crown portion in overhanging relation with said ports;

hanger means constructed to engage spaced portions of said heat-emitting section in support of the element centrally with respect to said side-wall portions, said hanger means engaging and connecting with said side-wall portions for the support thereof by said housing; and a sheet-like reflector of greater width in its planate condition than the distance between parts of the side-wall portions engaged by said hanger means, said reflector being normally positioned in concavo-convex configuration between, and in spaced relation with, said crown portion and said element with the lateral edges of the reflector engagably received by surfaces defined by said side-wall portions and the hanger means adjacent the connections thereof; the periphery of said reflector extending into substantially continuous close proximity with said end plates and said side-wall portions.

2. A self-ventilating infra-red ray heater comprising:

an arcade-type housing having a crown portion and terminating laterally in opposite side-wall portions in respect to its longitudinal axis to define a longitudinally coextensive cavity and an opening therefor between said wall portions, said wall portions defining detent shoulders at opposite sides of the cavity facing thereinto;

an elongate heating element having a heat-emitting section of a length substantially that of the housing adapted to be mounted adjacent to said opening with a mounting section of the element extending beyond one end of the housing;

first and second end plates having main planate sections of a size sufficient to cover the opposite ends of said housing, said first end plate having aperture means enabling extension of said element mounting section therethrough;

first fastening means for securing the element within said aperture means fixedly to said plate;

second fastening means for securing said end plates to said housing;

said crown portion having openings within end portions thereof adjacent to the end plates to define ventilation ports therethrough;

upper flanges on said end plates turned inwardly over, and spaced from, said crown portions in overhanging relation with said openings;

hanger means constructed to receive longitudinally spaced portions of said heat-emitting section comprising tab means for engaging said shoulders; and a sheet-like flexible reflector of greater width in its planate condition than the distance between opposite shoulders normally received in arcuate configuration within said cavity between said hanger means and the entire inner surface of the housing, said reflector normally engaging said side-wall portions and said tab means to fix the position of said element with the entire periphery thereof extending into continuous close proximity with said end plates and said housing.

3. The heater of claim 2 comprising:

a weather-repellant shield extending over said housing, said shield being shorter than the distance between the main planate section of the end plates to expose said openings but at least as long as the distance between said overhanging flanges;

said shield having side walls that are substantially coextensive with said side-wall portions of the housing; and means for attaching the shield to the assembly comprising the housing and the end plates.

4. The heater of claim 2 wherein:

each flange comprises a distal web turned inwardly toward said crown portion as a weather barrier.

5. The heater of claim 4 comprising:

a weather shield extending over said housing, said shield being shorter than the distance between main planate sections of said end plates to expose said openings but longer than the distance between said webs enabling portions of the flanges to overhang the shield;

said shield having side walls which extend into juxtaposed relation with housing side-wall portions; and fastening means connecting the shield to an assembly comprising end plates and said housing.

6. The heater of claim 2 wherein:

each end plate has a lower flange turned outwardly from the housing;

the heater further comprises an outer reflector of inverted funnel shape having upper flanges adapted for mating relation with said lower end-plate flanges; and fastening means for securing said upper flanges and said lower flanges together.

7. The heater of claim 6 comprising:

a weather shield extending over said housing, said shield being shorter than the distance between main planate sections of said end plates to expose said recesses but longer than the distance between said overhanging flanges;

said shield having side walls which extend into juxtaposed overlapping relation with upper side-wall portions of said outer reflector; and fastening means for securing said shield side walls to said reflector sidewall portions.

* * * * *